United States Patent [19]

Schumaker

[11] Patent Number: 4,498,125

[45] Date of Patent: Feb. 5, 1985

[54] LAMP WITH ONE ARM FORK SUPPORT

[75] Inventor: Eugene J. Schumaker, Milwaukee, Wis.

[73] Assignee: Adjustable Fixture Company, Milwaukee, Wis.

[21] Appl. No.: 427,147

[22] Filed: Sep. 29, 1982

[51] Int. Cl.[3] ..... F21S 5/00

[52] U.S. Cl. ..... 362/216; 362/311; 362/414; 362/353; 362/448; 362/361; 362/356

[58] Field of Search ..... 362/216, 347, 361, 417, 362/427, 432, 433, 211, 353, 356, 414, 448

[56] References Cited

U.S. PATENT DOCUMENTS

| | | | |
|---|---|---|---|
| 83,711 | 11/1868 | Hunter et al. | 362/417 X |
| 177,921 | 5/1876 | Bonnell, Jr. | 362/361 |
| 275,641 | 4/1883 | Gordon | 362/361 |
| 589,489 | 9/1897 | Wolff | 362/361 |
| 1,040,072 | 10/1912 | Wehr | 362/361 |
| 1,863,767 | 6/1932 | Shapiro | 362/361 X |
| 1,977,401 | 10/1934 | Orth | 362/417 X |
| 2,503,931 | 4/1950 | Young | 362/216 |
| 2,531,523 | 11/1950 | Moser | 362/433 |
| 2,618,739 | 11/1952 | Fleishman | 362/216 |
| 3,077,537 | 2/1963 | Squier | 362/216 X |
| 4,009,384 | 2/1977 | Holland | 362/433 |

FOREIGN PATENT DOCUMENTS

| | | | |
|---|---|---|---|
| 527031 | 7/1921 | France | 362/417 |
| 24953 | 10/1912 | United Kingdom | 362/417 |
| 444031 | 4/1975 | U.S.S.R. | 362/433 |

*Primary Examiner*—Peter A. Nelson

*Attorney, Agent, or Firm*—Fred Wiviott

[57] ABSTRACT

A lamp includes a cup for being affixed to a support and for enclosing a lamp socket. An arm is affixed to the cup and has an initial portion extending upwardly and outwardly and an upper portion extending inwardly to a terminal end located vertically above the cup. A lamp shade is fixed to the terminal end of said arm which is the sole support for said lamp shade. The arm is preferably formed of a relatively heavy gauge tubular material.

6 Claims, 3 Drawing Figures

LAMP WITH ONE ARM FORK SUPPORT

BACKGROUND OF THE INVENTION

This invention relates to lamps and more particularly to lamps for institutional use.

In prior art lamps, the shades were generally mounted on a resilient member called a harp, and having an inverted, generally U-shape. These prior art harps were secured to the lamp by forcing the two legs inwardly so that they could be inserted into receptacles mounted at the base of the lamp socket housing. In order to provide the desired resilience, such prior art harps were formed of a relatively thin metallic material. As a result, such harps were relatively easily detached so that expensive lighting units such as fluorescent lighting devices adapted for conventional sockets could be removed without difficulty. In addition, these members were not damage resistant when subjected to abuse.

SUMMARY OF THE INVENTION

It is an object of the invention to provide a new and improved lamp particularly adapted for institutional use such as college dormitories.

A further object of the invention is to provide a lamp which does not readily permit the casual removal of lighting units.

Another object of the invention is to provide a new and improved lamp which is damage resistant.

These and other objects and advantages of the present invention will become more apparent from the detailed description hereof taken with the accompanying drawings.

In general terms, the invention comprises a lamp including a cup adapted to be affixed to a support and for enclosing a lamp socket. An arm is affixed to the cup and has an initial portion extending upwardly and outwardly and an upper portion extending inwardly to a terminal portion vertically above the cup means. A lamp shade is fixed to the terminal portion of said arm which is the sole support for said lamp shade. The arm is preferably formed of a relatively heavy gauge tubular material.

DETAILED DESCRIPTION OF THE PREFERRED EMBODIMENT

Figure 1:
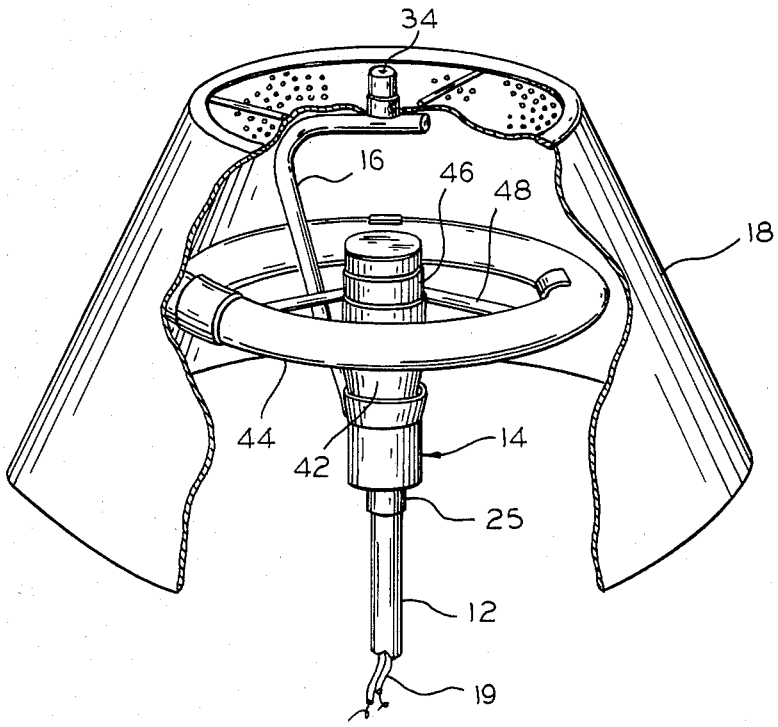
FIG. 1 is a prospective view, with parts broken away, of the lamp according to the preferred embodiment of the invention.
Figure 2:
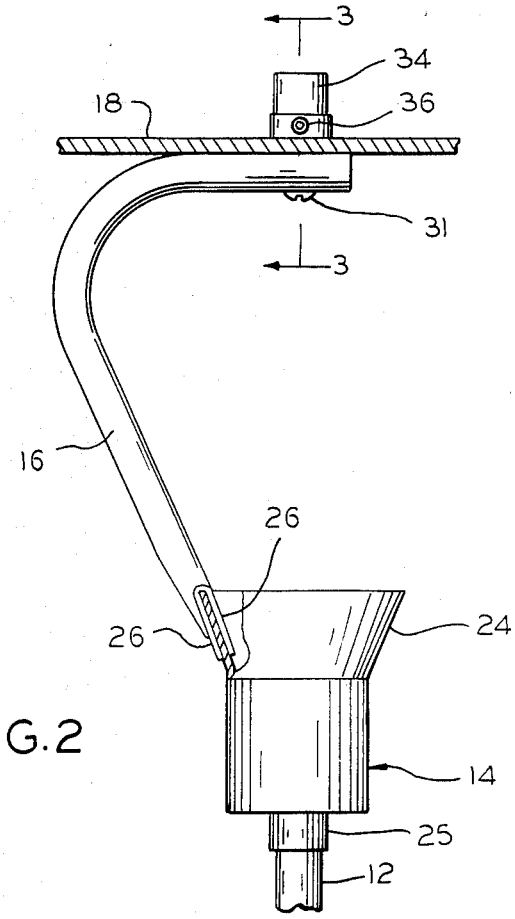
FIG. 2 is an enlarged view showing a portion of the lamp illustrated in FIG. 1.
Figure 3:
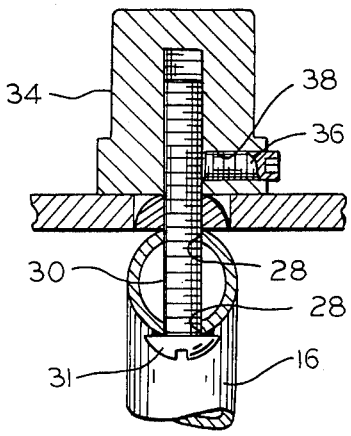
FIG. 3 is a view taken along lines 33 of FIG. 2.

The lamp 10 in accordance with the preferred embodiment of the invention is shown in FIG. 1 to include a stem 12, a socket cup 14 mounted at the upper end of stem 12, a support arm 16 attached at its lower end to the cup 14 and extending upwardly therefrom for supporting a lamp shade 18. Those skilled in the art will appreciate that the stem 12 is supported on a conventional lamp base (not shown). Electrical conductors 19 extend upwardly through the stem 12 and are connected to a conventional socket (not shown) which is disposed within the cup 14.

The cup 14 has a cup-shaped body portion 20 and a frusto conical skirt portion 24 which extends obliquely outwardly from the upper end of the cup portion 22. A collar 25 is integral with the base of the cup portion 22 and is suitably affixed to the upper end of the stem 12. The arm 16 comprises a hollow tubular member formed of a relatively heavy gauge metal. At its lower end, the arm is forked to provide fingers 26 embracing the opposite sides of the skirt 24 and which may be attached thereto in any suitable manner such as by welding. The cup 14 is also formed of a relatively heavy gauge metal.

From its lower end, the arm 16 extends upwardly and generally outwardly and then inwardly for defining a generally horizontal section which terminates vertically above the cup 14. A pair of apertures 28 are formed through the arm 16 and coaxially with the stem 12 for receiving a bolt 30 therethrough. The head 31 of bolt 30 is affixed, such as by welding to the arm 16 and around the lower hole 28. The shade 18 includes a mounting ring 32 which is receivable over the bolt 30 and is secured thereto by means of an internally threaded finial 34. The finial 34 is secured to the bolt 30 against casual removal by means of a set screw 36 which extends through a threaded aperture 38 formed in finial 34 and normally to the axis of the bolt 30.

FIG. 1 shows the use of a fluorescent lighting unit 40 employed with the lamp 10, although it will be understood that any conventional bulb may be used. As those skilled in the art will appreciate, such lighting units comprise a base assembly 42 which contains a transformer and is threadably received into a conventional lamp socket. In addition, the unit 40 includes a fluorescent bulb 44 mounted on the base 42 and electrically connected thereto by means of a hub 46 mounted on the base and a plurality of spokes 48 radiating from hub 46 for engaging the bulb at their outer ends. It will be appreciated that the arm 16 is disposed in the gap between the base 42, the bulb 44, and two of the spokes 41. As a result, when the shade 18 is in position and is secured by the finial 34, the lighting unit 40 cannot be removed without the use of a tool required to loosen the set screw 36. This discourages the theft of such lighting units which are relatively expensive. Of course installation of the lighting unit also requires removal of the shade so that the bulb 44 can be inserted over and around the arm 16.

The arm 16 is also relatively strong and is rigidly connected to the cup 14. Accordingly, the arm is relatively damage resistant when subjected to abuse.

While only a single embodiment of the invention has been illustrated and described, it is not intended to be limited thereby, but only by the scope of the appended claims.

I claim:

1. A lamp including cup means for being affixed to a support and for enclosing a lamp socket, said cup means having a skirt portion at its upper end, an arm affixed to said cup means and having an initial portion extending upwardly and outwardly and an upper portion extending inwardly to a terminal portion vertically above the cup means, said arm being forked at its lower end to define portions engaging the opposite sides of said skirt portion for being affixed thereto, and means for affixing a lamp shade to the terminal portion of said arm, said arm being the sole support for said lamp shade.

2. The lamp set forth in claim 1 wherein said arm comprises a hollow tubular member, and means for locking said shade to the terminal end of said arm.

3. The lamp set forth in claims 1 or 2 and including a lamp socket disposed in said cup means, a fluorescent lighting unit having a base portion disposed in said socket and an annular fluorescent lamp supported by spoke means from said base portion, said arm extending between said base portion and said fluorescent lamp to prevent removal of said lighting unit without removing said shade.

4. A lamp including a support, a cup means affixed to said support for enclosing a lamp socket and having a generally vertical axis, said cup means having a skirt portion at the upper end thereof, an arm affixed at one end to said cup means and having an initial portion extending upwardly an outwardly from said cup means and an upper portion extending inwardly to an opposite end portion disposed vertically above the cup means and generally along said axis, said arm being forked at its lower end to define portions engaging the opposite sides of said skirt portion for being affixed thereto, a lamp shade extending around said cup means, and means disposed along said axis for affixing said lamp shade to the opposite end of said arm, said arm being the sole support for said lamp shade.

5. The lamp set forth in claim 4 wherein said arm comprises a hollow tubular member, and means for locking said shade to the opposite end of said arm.

6. The lamp set forth in claims 4 or 5 and including a lamp socket disposed in said cup means, a fluorescent lighting unit having a base portion disposed in said socket and an annular fluorescent lamp supported by spoke means from said base portion, said arm extending between said base portion and said fluorescent lamp to prevent removal of said lighting unit without removing said shade.

* * * * *